US009865967B2

(12) United States Patent
Sasaki et al.

(10) Patent No.: US 9,865,967 B2
(45) Date of Patent: Jan. 9, 2018

(54) CONNECTOR

(71) Applicant: Tyco Electronics Japan G.K., Kanagawa (JP)

(72) Inventors: Yoichi Sasaki, Kanagawa (JP); Makiya Kimura, Tokyo (JP)

(73) Assignee: Tyco Electronics Japan G.K., Kanagawa-ken (JP)

( * ) Notice: Subject to any disclaimer, the term of this patent is extended or adjusted under 35 U.S.C. 154(b) by 0 days.

(21) Appl. No.: 15/141,310

(22) Filed: Apr. 28, 2016

(65) Prior Publication Data

US 2016/0322746 A1 Nov. 3, 2016

(30) Foreign Application Priority Data

Apr. 28, 2015 (JP) ..... 2015-091238

(51) Int. Cl.

| | |
|---|---|
| ***H01R 13/15*** | (2006.01) |
| ***H01R 13/629*** | (2006.01) |
| ***H01R 12/71*** | (2011.01) |
| ***H01R 13/502*** | (2006.01) |
| ***H01R 13/6585*** | (2011.01) |
| *H01R 12/88* | (2011.01) |
| *H01R 13/639* | (2006.01) |

(52) U.S. Cl.

CPC ..... *H01R 13/62955* (2013.01); *H01R 12/714* (2013.01); *H01R 13/502* (2013.01); *H01R 13/6585* (2013.01); *H01R 12/88* (2013.01); *H01R 13/62994* (2013.01); *H01R 13/639* (2013.01)

(58) Field of Classification Search

CPC ..... H01R 13/62955; H01R 13/6215; H01R 13/6585; H01R 13/62994; H01R 12/714; H01R 13/502; H01R 13/6658; H01R 12/88; H01R 13/639

USPC ..... 439/259

See application file for complete search history.

(56) References Cited

U.S. PATENT DOCUMENTS 5,940,639 A * 8/1999 Salvas ..... G03B 17/40 396/263
6,299,362 B1 * 10/2001 Gilliland ..... H01R 13/6658 385/92
6,931,961 B2 * 8/2005 Bauer ..... F16H 59/0204 200/61.88

(Continued)

FOREIGN PATENT DOCUMENTS

JP 2001217040 A 8/2001
JP 2001351747 A 12/2001

(Continued)

OTHER PUBLICATIONS

European search report, dated Sep. 6, 2016, 7 pages.
Abstract of JP2001217040, dated Aug. 10, 2001, 2 pages.

*Primary Examiner* — Jean F Duverne
(74) *Attorney, Agent, or Firm* — Barley Snyder

(57) ABSTRACT

A connector is disclosed. The connector comprises a circuit board having a plurality of contact pads arranged in a two-dimensional fashion on a first face facing a mating connector side, the plurality of contact pads configured to make contact with a plurality of contacts of a mating connector, and a housing having a locating portion in contact with the first face of the circuit board, the locating portion locating the first face with respect to a direction of mating with the mating connector.

17 Claims, 14 Drawing Sheets

(56) References Cited

U.S. PATENT DOCUMENTS

| | | | | |
|---|---|---|---|---|
| 7,147,504 | B2 * | 12/2006 | Ikeya | H01R 13/6215 439/364 |
| 8,847,618 | B1 * | 9/2014 | Michalko | G01R 31/2808 324/750.19 |
| 2004/0002249 | A1 * | 1/2004 | Yamada | H01R 12/714 439/364 |
| 2013/0106287 | A1 * | 5/2013 | Savicki, Jr. | H05B 33/0815 315/113 |

FOREIGN PATENT DOCUMENTS

| | | | |
|---|---|---|---|
| JP | 3332900 | B2 | 7/2002 |
| WO | 2013027330 | A1 | 2/2013 |
| WO | 2013157616 | A1 | 10/2013 |

* cited by examiner

CONNECTOR

CROSS-REFERENCE TO RELATED APPLICATION

This application claims the benefit of the filing date under 35 U.S.C. §119(a)-(d) of Japanese Patent Application No. 2015-091238, filed Apr. 28, 2015.

FIELD OF THE INVENTION

The present invention relates to an electrical connector, and more particularly, to an electrical connector provided with a circuit board having a plurality of contact pads.

BACKGROUND

As is known in the art, some electronic apparatuses used in high-performance applications, such as medical devices, are required to transmit and receive signals of considerably numerous channels. In such apparatuses, multichannel connectors suitable for transmitting and receiving multichannel signals are used.

JP 2001-351747A discloses an example of such a multichannel connector. The connector disclosed in JP 2001-351747A is provided with a circuit board having a plurality of contact pads formed on a first face thereof and arranged in a two-dimensional fashion. This circuit board is fixed to a housing surface from a mating connector side, having the first face facing the mating connector.

In the case of the connector disclosed in JP 2001-351747A, the positioning of the circuit board within the housing is dictated by a second face opposite to the first face, which contacts the housing. Variations in thickness or warping of the circuit board may cause the position of the contact pads formed on the first face to fluctuate relative to the mating connector. The variations of this position also cause a contact pressure with the mating connector to fluctuate, resulting in an unstable contact and corresponding connection. Moreover, a connector having this structure is unadaptable to a circuit board having a different board thickness.

SUMMARY

An object of the invention, among others, is to provide improved positional precision of a first face of a connector having contact pads formed thereon. The disclosed connector comprises a circuit board having a plurality of contact pads arranged in a two-dimensional fashion on a first face facing a mating connector side, the plurality of contact pads configured to make contact with a plurality of contacts of a mating connector, and a housing having a locating portion in contact with the first face of the circuit board, the locating portion locating the first face with respect to a direction of mating with the mating connector.

BRIEF DESCRIPTION OF THE DRAWINGS

The invention will now be described with reference to the accompanying figures, of which.

DETAILED DESCRIPTION OF THE EMBODIMENT(S)

The invention is explained in greater detail below with reference to embodiments of an electrical connector. This invention may, however, be embodied in many different forms and should not be construed as limited to the embodiments set forth herein; rather, these embodiments are provided so that this disclosure will be thorough and complete and still fully convey the scope of the invention to those skilled in the art.

Figure 1:
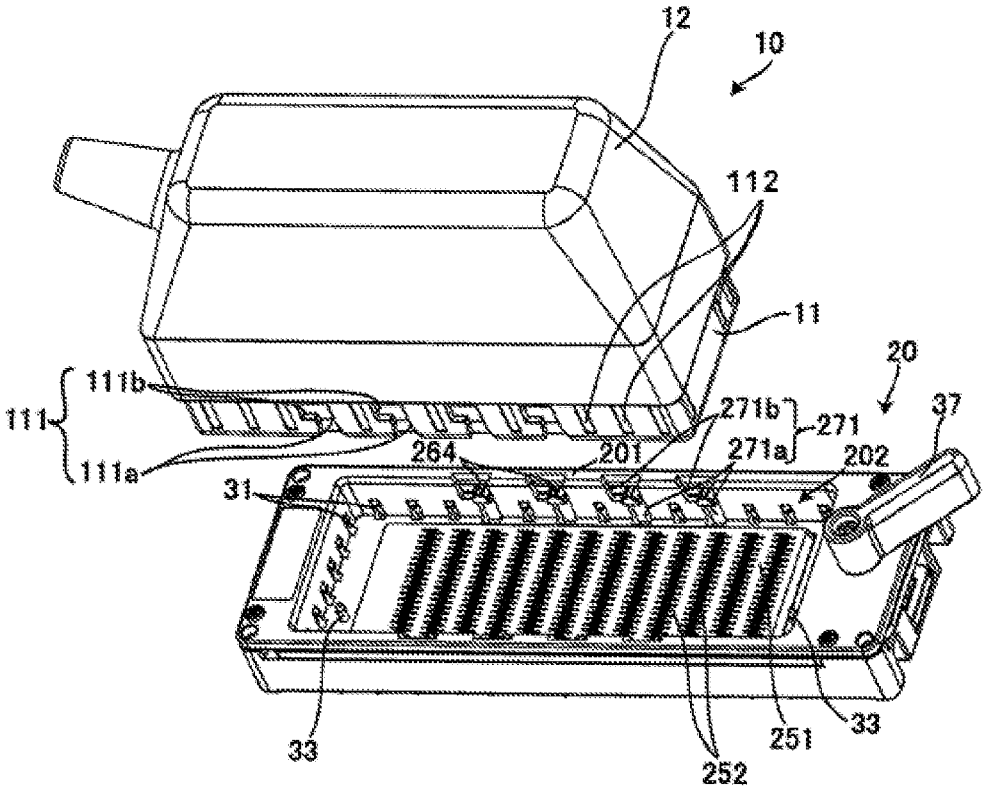
FIG. 1 is a perspective view of a first connector and a second connector according to the invention before mating.
Figure 2:
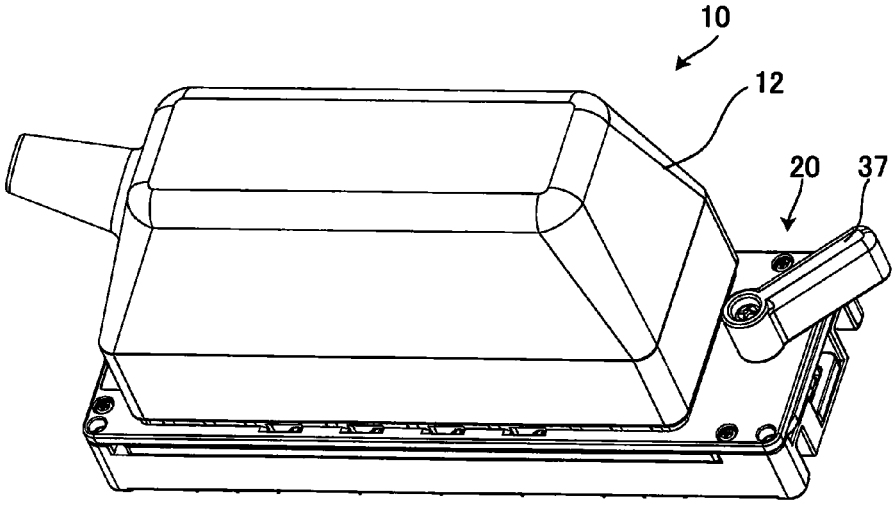
FIG. 2 is a perspective view of the first connector and the second connector shown in FIG. 1 in a mating state.

The electrical connector according to the invention, as shown generally in FIGS. 1 and 2, includes a first connector 10 and a second connector 20. The major components of the invention will now be described in greater detail.

Figure 3:
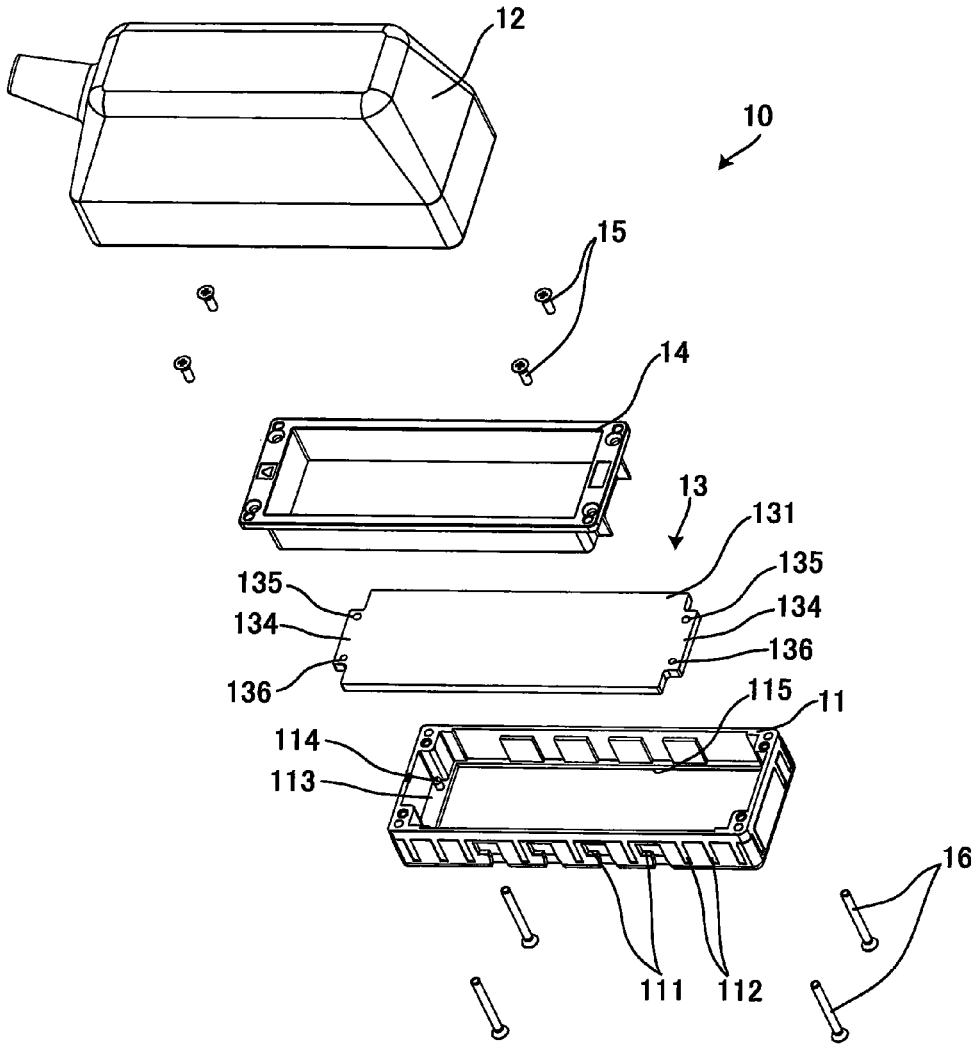
FIG. 3 is an exploded perspective view of the first connector.

The first connector 10, as shown in FIG. 3, is provided with a circuit board 13 and a retainer 14 in addition to a frame 11 and a cap 12. The first connector 10 has a shape where the large cap 12 has been attached on to the frame 11. A cable (not shown) composed of a plurality of electric wires is connected within the cap 12.

The frame 11 may be made of metal, and is provided with a plurality of lock grooves 111 and shield contact portions 112 on an outside face thereof. As shown in FIG. 1, the lock groove 111 is an L-shaped groove having a first portion 111*a* opened toward an end portion extending in a mating direction and a second portion 111*b* extending laterally on a depth side of the first portion 111*a*. The frame 11 also has a plurality of locating pins 114 provided on a stand portion 113. The locating pins 114 are provided such that one thereof is allocated to each of the left and right stand portions 113, in this exemplary embodiment, two total locating pins 114 are positioned within the frame 11. These two locating pins 114 are provided near the same side in the widthwise direction, as shown in FIG. 3. The frame 11 also has a large opening 115 on a lower face side.

The cap 12, as shown in FIG. 3, is formed in a dome shape bulging upward.

Figure 4A:
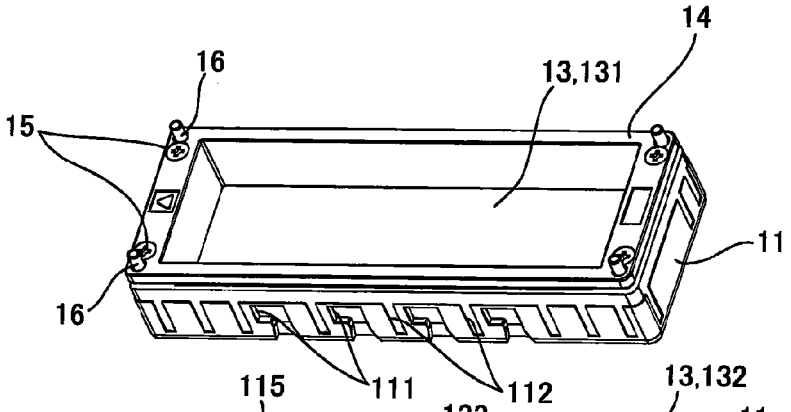
FIG. 4A is a perspective view of an upper face side of the first connector.
Figure 4B:
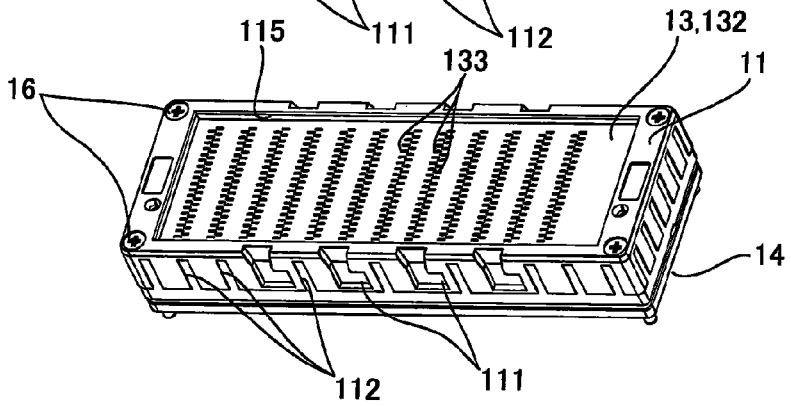
FIG. 4B is a perspective view of a lower face side of the first connector.

The circuit board 13 has a plurality of contact pads 133 arranged in the circuit board 13 in a two-dimensional fashion on a lower face 132, as shown in FIG. 4B, facing in the opposite direction to an upper face 131 shown in FIG. 3. The term "two-dimensional fashion" in this specification includes such a case that rows or columns adjacent to each other are staggered to each other in addition to a case where the contact pads 133 are arranged in a matrix shape. The lower face 132 of the circuit board 13 is the mating face of the first connector 10 to the second connector 20.

Further, the circuit board 13 has tongue portions 134 projecting at left and right sides, and locating holes 135 and 136 provided in the tongue portions 134. The tongue portions 134 correspond to and are positioned on the stand portions 113 of the frame 11. The circuit board 13 is placed in such a state that the tongue portions 134 have been placed on the stand portions 113 of the frame 11 and the locating pins 114 of the frame 11 have been pushed into the locating holes 135 of the circuit board 13. Thereby, the circuit board 13 is positioned within the frame Two locating holes 135 and 136 are provided in each of the left and right tongue portions 134. On one hand, the number of locating pins 114 provided on these stand portions 113 is one per each of the respective left and right stand portions 113. The locating pins 114 provided on these stand portions 113 are inserted into respective one left and right locating holes 135 of the two locating holes 135 and the two locating holes 136 in the two left and right tongue portions 134, respectively, so that locating of the circuit board 13 to the frame 11 is performed. The contact pads 133 on the lower face 132, shown in FIG. 4B, make contact with the stand portions 113 of the frame 11, and the lower face 132 is thereby positioned with respect to the frame 11. Therefore, even if variations of thicknesses in the circuit board 13 or the like are present, the contact pads 133 on the circuit board 13 are always located to the frame 11 correctly.

The retainer 14 is a frame-shaped member having a through-hole at a central portion thereof. The retainer 14 makes contact with the upper face 131 of the circuit board 13 supported by the frame 11 and fixes the circuit board 13 to the stand portions 113 of the frame 11 when the retainer 14 is pushed on to the stand portions 113. Thereby, the circuit board 13 is fixed in a state where it has been securely pushed on to the stand portions 113 of the frame 11.

Fixing of respective parts constituting the first connector 10 may be performed by four short screws 15 and four long screws 16. The short screws 15 are screwed to the frame 11 from the side of the retainer 14, as shown in FIG. 3. Thereby, the retainer 14, the circuit board 13 and the frame 11 are fixed in an integrated fashion. Further, the long screws 16 are pushed from the opposite side of the frame 11, as shown in FIG. 3, to fix the cap 12 to the frame 11.

In the assembled first connector 10, shown in FIG. 1, the upper face 131 of the circuit board 13 is opened to the side of the cap 12 through the central portion of the retainer 14. The circuit board 13 is sandwiched between the frame 11 and the retainer 14. The lower face 132 of the circuit board 13 formed with the contact pads 133 is located by the frame 11 with a high precision. Due to the shape of the cap 12, a wide space is formed between the cap 12 and the upper face 131 of the circuit board 13.

In the aforementioned embodiment, a configuration obtained by combining the frame 11 and the retainer 14 is referred to as an example of the housing, and the stand portion 113 of the frame 11 is referred to as an example of the locating portion. Further, the retainer 14 corresponds to one example of the fixing portion of the housing.

Figure 5:
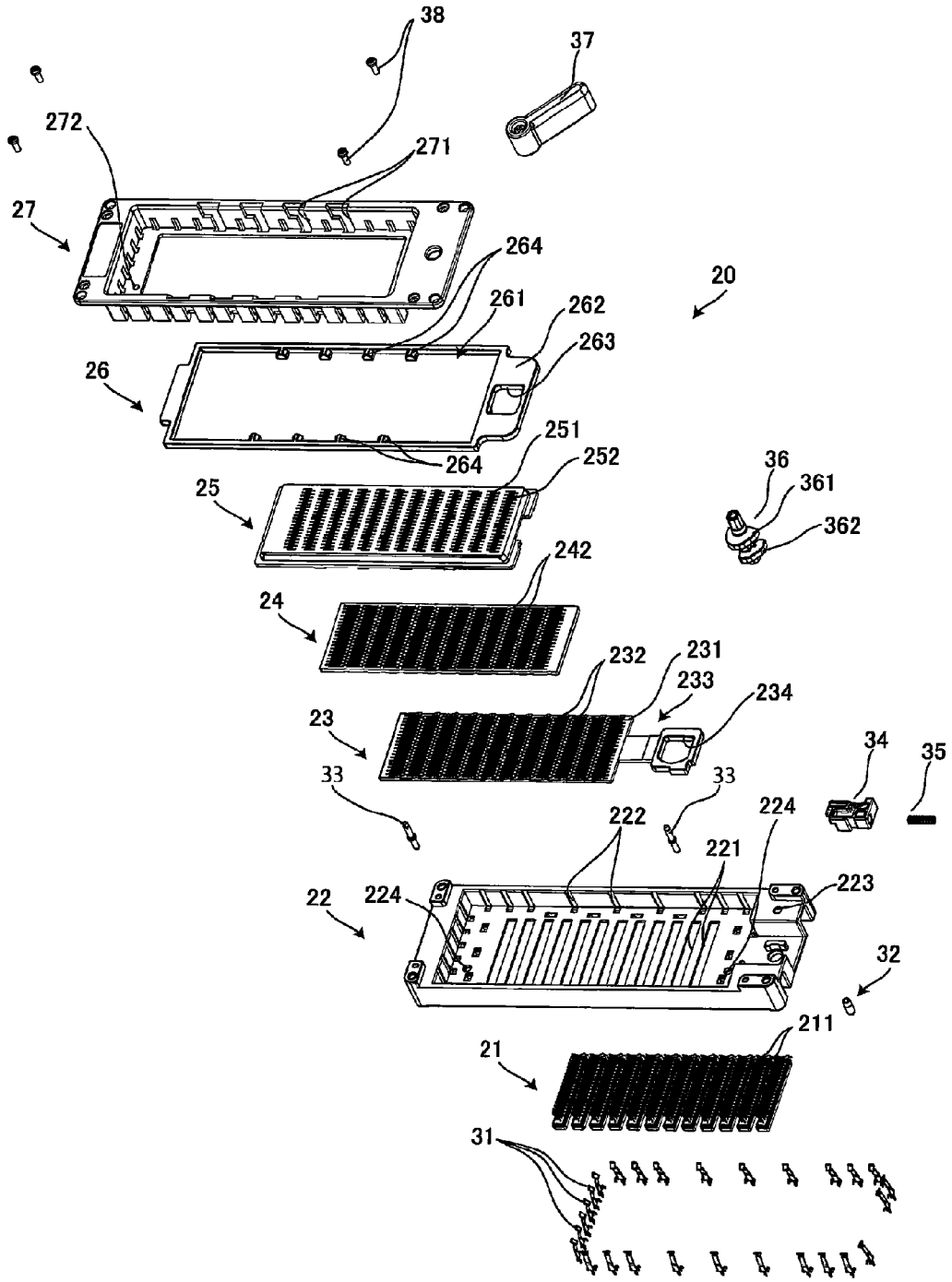
FIG. 5 is an exploded perspective view of the second connector.

The second connector 20, as shown in FIG. 1, has a wall 201 and a mating portion 202. The second connector 20, as shown in FIG. 5, also has contact blocks 21, a base housing 22, a slider 23, a lift plate 24, an upper housing 25, a lock plate 26, and a shell 27.

A plurality of contact blocks 21 is provided. The exemplary embodiment of FIG. 5 shows twelve contact blocks. A plurality of contacts 211 insert-molded is arranged in each contact block 21.

The base housing 22 is formed in a rectangular shape, and is surrounded by a wall and is recessed at a central portion thereof. The base housing 22 may be made of metal. Long holes 221 are formed on a recess-shaped bottom face along with bottom holes 224 positioned on the bottom face outside of the long holes 221. Each contact block 21 is press-fitted into each long hole 221 from a back face side of the base housing 22, and the contacts 211 are arranged inside the base housing 22 through the long hole 221. The base housing 22 also has shield member arrangement portions 222 disposed along the wall of the base housing 22 and top hole 223.

The slider 23 has a projecting portion 233 projecting in its longitudinal direction, and the projecting portion 233 is formed with a cam hole 234. Further, an upper face 231 (a face on the side of the lift plate 24) of the slider 23 constitutes a convex cam face having a plurality of projecting portions 235.

The slider 23 and the lift plate 24 are arranged in the recessed portion of the base housing 22 from above the base housing 22, and the upper housing 25 is further placed on the lift plate 24. The slider 23 and the lift plate 24 are formed with a plurality of holes 232 and 242 for allowing penetration of a plurality of contacts 211. A plurality of holes 252 for allowing penetration of the contacts 211 are also formed in the upper housing 25. Uppermost portions of the contacts 211 enter the holes 252 on the mating face 251 of the upper housing 25. However, in a state where a force is not applied to the contacts 211, the uppermost portions of the contacts 211 enter the holes 252 of the upper housing 25 and do not protrude above the upper housing 25.

Figure 9:
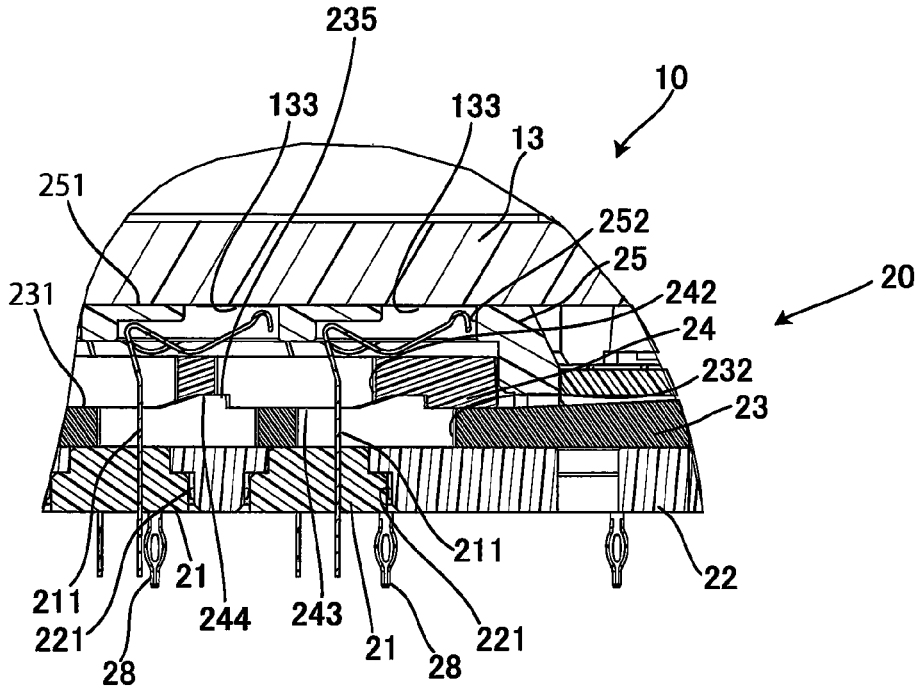
FIG. 9 is an enlarged view of portion D of FIG. 8C.

The lift plate 24 overlaps with the slider 23. A lower face (a face on the side of the slider 23) of the lift plate 24 constitutes a cam reception face having a recessed shape with a plurality of recessed portions 244 corresponding to projection portions 235 on the upper face 231 of the slider 23, as shown in FIG. 9.

The lock plate 26 is arranged further above the upper housing 25. The lock plate 26 has a frame shape surrounding a large opening 261, and it is provided with a projecting portion 262 in its longitudinal direction. A cam hole 263 is formed in the projecting portion 262 at a position at which the first cam 361 of the cam member 36 enters. Further, a plurality of lock projections 264, as shown in FIGS. 1 and 5, projecting inside the opening 261 are formed in the lock plate 26.

The shell 27 is arranged so as to enter the opening 261 of the lock plate 26. The lock projections 264 of the lock plate 26 enter the L-shaped lock grooves 271 provided in the shell 27. Each lock groove 271 has a first portion 271*a* extending in the mating direction (facing a depth of the recess) and a second portion 271*b* extending laterally so as to be wholly formed in an L shape. However, the second portion 271*b* is formed on an upper end side of the first portion 271*a* to be opened upward (on the side of the first connector 10). The shell 27 also has a shell hole 272 as shown in FIG. 5.

Further, as shown in FIG. 5, the second connector 20 has a plurality of shield members 31, a ball plunger 32, two post pins 33, a lock block 34, a lock block spring 35, a cam member 36, a lever 37, and a plurality of screws 38.

The shield members 31 are arranged on the base housing 22 so as to take an attitude along the shield member arrangement portions 222 provided on the side of an inner wall of the wall surrounding the base housing 22.

The ball plunger 32 is plugged into the hole 223 of the base housing 22. The ball plunger 32 makes contact with a back face of the projecting portion 262 of the lock plate 26 after assembled. As described above, the lock plate 26 is slid according to rotation of the cam member 36. Recesses (not shown) are formed in the back face of the projecting portion 262 of the lock plate 26 at two positions at which the ball plunger 32 contacts, the two points constituting a starting point and an end point of the sliding of the lock plate 26. The ball plunger 32 slightly locks the lock plate 26 at the two positions of the starting point and the end point of the sliding of the lock plate 26 and provides a clicking feeling to a user rotationally operating the lever 37 described later.

The two post pins 33 are plugged into the bottom holes 224. In addition, the post pins 33 penetrate two holes 272 provided in the shell 27, and they are put in a protruded state from the mating portion 202 of the second connector 20, as shown in FIG. 1.

Figure 6:
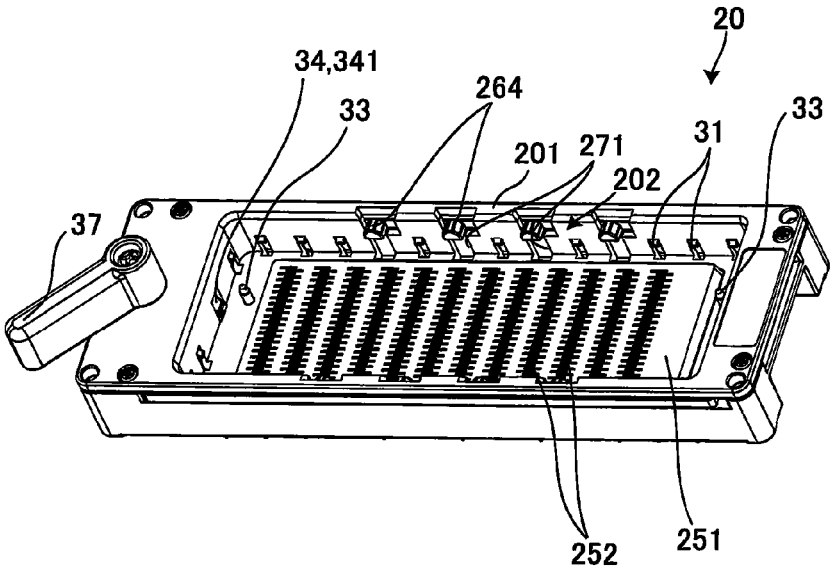
FIG. 6 is a perspective view of the second connector in an assembled state.

The lock block 34 and the lock block spring 35 are arranged on the base housing 22. The lock block 34 is pushed by the lock block spring 35 so that a distal end portion 341 of the lock block 34, shown in FIG. 6, is put in a protruded state into the recess-shaped mating portion 202 of the second connector 20. In this state, rotation of the cam member 36 is blocked.

The cam member 36 has the first cam 361 and a second cam 362. The first cam 361 is located in the cam hole 263 of the lock plate 26 and it slides the lock plate 26 according to rotation of the cam member 36. Further, the second cam 362 is located in the cam hole 234 of the slider 23 and it slides the slider 23 according to rotation of the cam member 36. When the lift plate 24 is at a lowered position, the projection portions 235 on the upper face 231 of the slider 23 enter recess portions 244 in the lower face 243 of the lift plate 24. When the cam member 36 is rotated, the slider 23 is slid laterally according to an action of the second cam 362. Thereby, the projection portions 235 on the upper face 231 of the slider 23 make contact with projection portions on the lower face 243 of the lift plate 24 to lift up the lift plate 24. The lift plate 24 lifts up the plurality of contacts 211 simultaneously.

The lever 37 is screwed to the cam member 36. The lever 37 is rotationally operated by a user. When the lever 37 is rotated, the cam member 36 is also rotated integrally with the lever 37.

A plurality of screws 38 fix the shell 27 to the base plate 22. Thereby, respective parts arranged so as to be sandwiched between the shell 27 and the base plate 22 are fixed.

In the second connector 20, a configuration obtained by combining the base housing 22 and the shell 27 in the aforementioned exemplary embodiment is referred to as the housing. Further, the slider 23 corresponds to an example of the slide plate. The lift plate 24 corresponds to an example of the moving plate.

A mating operation of the first connector 10 and the second connector 20 will now be described in greater detail.

The recess-shaped mating portion of the second connector 20 is surrounded by the wall 201 on a side facing the first connector 10. The second connector 20 is fixed and connected to an apparatus. As shown in FIG. 2, the first connector 10 is mated with the second connector 20 such that a front end thereof facing the side of the second connector 20 is fitted into a recess-shaped mating portion 202 of the second connector 20.

The plurality of connection pads 133 arranged on a mating face of the first connector 10 face the side of the second connector 20 in a two-dimensional fashion. When the first connector 10 is mated with the second connector 20, the mating face of the first connector 10 faces a mating face 251 of the second connector 20 in a state approximately contacting with the mating face 251 of the second connector 20. The mating face 251 of the second connector 20 is a bottom face of the recess-shaped mating portion 202 whose periphery is surrounded by the wall 201.

When the first connector 10 is mated with the second connector 20, the two post pins 33 are put in a state where they have been plugged into locating holes 136, as shown in FIG. 3, provided in the first connector 10. Both of these two post pins 33 are provided near the same side of the mating face 251 in the widthwise direction, therefore, the first connector 10 cannot be mated with the second connector 20 in the wrong direction in the longitudinal direction, so that mating is made possible only in the direction shown in FIG. 1 and FIG. 2.

The contacts 211 are arranged in the plurality of holes 252 of the mating face 251 on the same face as the mating face 251 or at a height slightly recessed from the mating face 251. The first connector 10 is mated with the second connector 20 so as to be put in a state shown in FIG. 2. As shown in FIG. 2, when the first connector 10 is mated with the second connector 20, the lock groove 111 of the first connector 10 and the lock groove 271 of the second connector 20 face each other so that an L-shaped passage is formed. The mating face of the circuit board 13 constituting the first connector 10, which is the lower face formed with the contact pads 133, overlaps with the mating face 251 which is the upper face of the upper housing 25.

The lever 37 is then rotationally operated. When the lever 37 is rotationally operated, the lock projection 264 moves laterally in a passage portion formed by the second portions **111*b* and 271*b* extending laterally in the L-shaped passage. The lock projection 264 first starts moving laterally according to an action of the first cam 361 when the cam member 36 is rotated. Thereby, the first connector 10 is locked to the second connector 20 in an immovable fashion by the lock projection 264**.

Next, the contact rises from the hole 252 of the mating face 251 of the second connector 20. The contacts 211 are moved to project from a plurality of holes 252 formed in the mating face 251 of the second connector 20 to make contact with the contact pads 133 of the first connector 10. However, the contacts elastically deform when they make contact with the contact pads. Therefore, the contacts hardly project from the holes 252 and are put in a state where they make contact with the contact pads 133 with a predetermined contact pressure. The contact which has risen is pushed on to the contact pad 133 formed on the mating face of the first connector 10 at a position facing the mating face 251 of the second connector 20.

The shield member 31 is provided in the second connector 20 in a contacting state with the base housing 22. When the first connector 10 is mated with the second connector 20, the shield members 31 provided in the second connector 20 make contact with shield contact portions 112 of the frame 11 of the first connector 10. Thereby, the first connector 10 and the second connector 20 are shielded integrally.

Figure 7A:
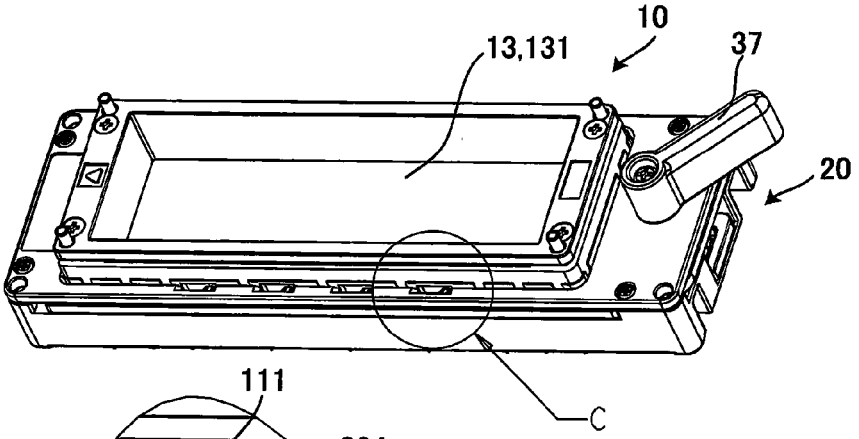
FIG. 7A is a perspective view of the mating state of FIG. 2 before a lever is rotationally operated.
Figure 7B:
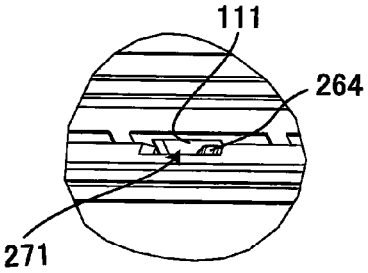
FIG. 7B is an enlarged view of portion C of FIG. 7A.

In a state before the lever 37 is rotationally operated, which is shown in FIGS. 7(A) and 7(B), the lock projections 264 are located at a position shown in FIG. 7(B) within the lock grooves 271 and 111. When the lock projections 264 are located at this position, the first connector 10 is not locked and it is put in a state detachable from the second connector 20.

Figure 8A:
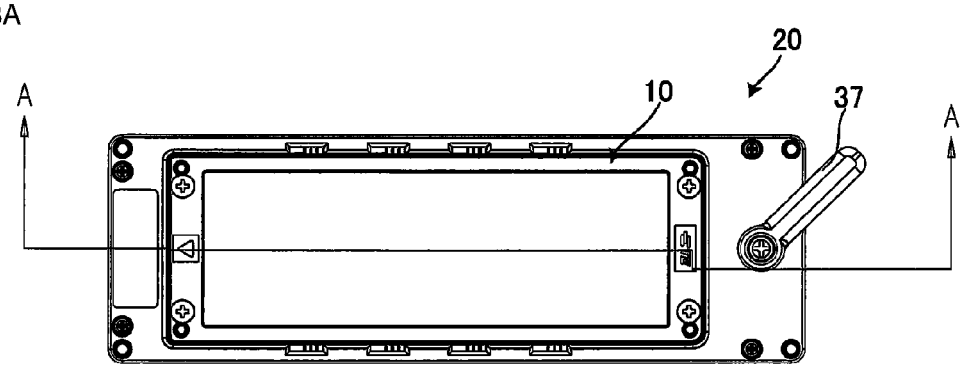
FIG. 8A is a plan view of the mating state shown in FIG. 7A.
Figure 8B:
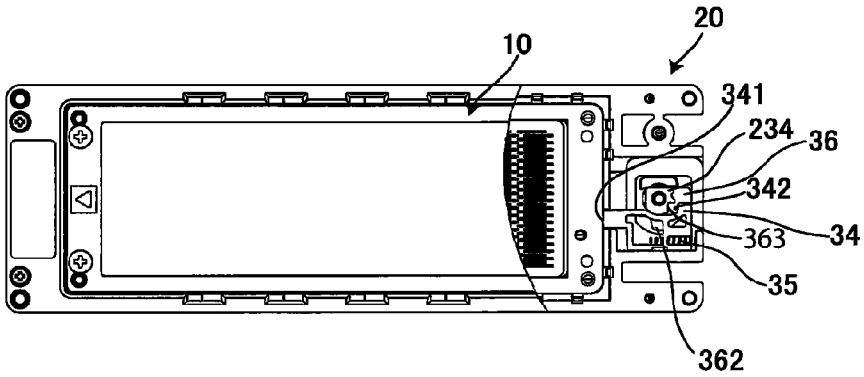
FIG. 8B is a partially-sectioned plan view of FIG. 8A.
Figure 8C:
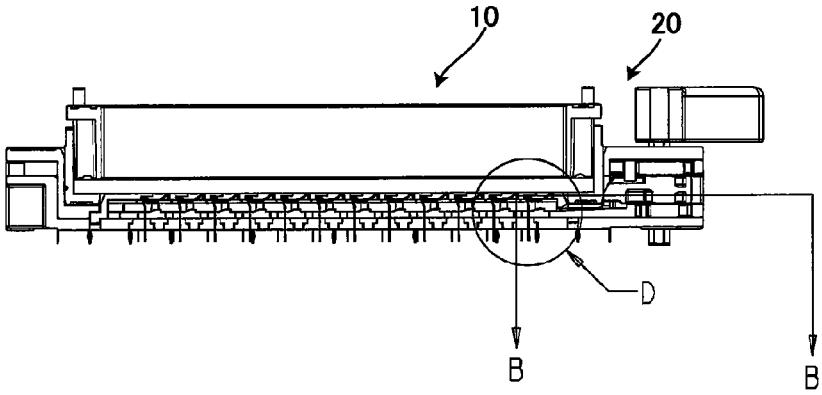
FIG. 8C is a vertical sectional view of FIG. 8A.

As shown in FIG. 8(B), the lock block 34 is slid to the right side in FIG. 8(B) according the distal end portion 341 pushed by the first connector 10 to be put in a shrunk state of the lock block spring 35. In this state, an abutting wall face 342 of the lock block 34 is spaced from a to-be-abutted wall face 363 of the cam member 36. That is, the cam member 36 is in an unlocked state, so that the cam member 36 can be rotated by operating the lever 37 rotationally.

When the first connector 10 is detached from the second connector 20, the lock block 34 is pushed by the lock block spring 35. The distal end portion 341 of the lock block 34 is put in a projecting state into the recess-shaped mating portion 202, as shown in FIG. 6. In this state, the abutting wall face 342 of the lock block 34 is caused to abut on the to-be-abutted wall face to be projected 363 of the cam member 36. Thereby, the cam member 34 is put in a locked state, and even if the lever 37 is forced to be rotated, the rotation is blocked by the lock block 34.

The contact block 21 is press-fitted into a long hole 221 of the base housing 22 from below the base housing 22. The contact 221 constituting the contact block 21 is protruded upward. The contact 211 penetrates the hole 232 of the slider 23 and the hole 242 of the lift plate 24 and an upper end portion thereof extends up to inside of the hole 252 of the upper housing 25. The circuit board 13 of the first connector 10 is located just above the upper housing 25. The contact pads 133 are formed on a lower face of the circuit board 13 facing the upper housing 25.

In the state shown in FIG. 9, namely, in a state before the lever 37 is rotationally operated, shown in FIG. 7 (FIGS. 7(A) and 7(B)), the projecting portions 235 of the slider 23 enter the recessed portions 244 of the lift plate 24. In this state, a pushing-up force from the lift plate 24 does not act on the contact 211.

Figure 10A:
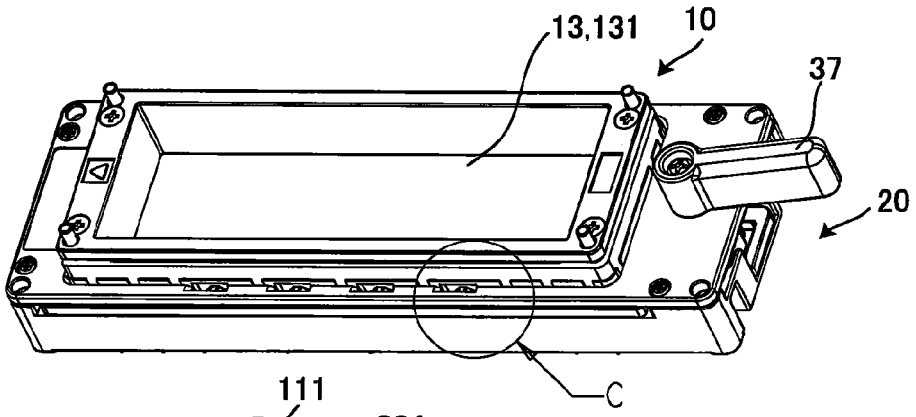
FIG. 10A is a perspective view of the mating state of FIG. 2 in which the lever has been rotated halfway.
Figure 10B:
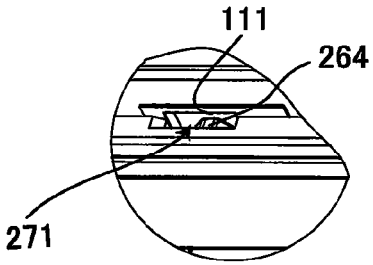
FIG. 10B is an enlarged view of portion C of FIG. 10A.

As shown in FIG. 10(A), the lever 37 is put in a state where it has been rotated halfway. In this state, as shown in FIG. 10(B), the lock projections 264 are put in halfway positions of the second portions 271*b* and 111*b* within the lock grooves 271 and 111 extending laterally. When the lock projections 264 move up to the position, the first connector 10 is already put in a locked state. That is, the first connector 10 cannot be detached from the second connector 20, and it is put in a fixed state in a mating state.

As described above, the cam projections 264 are provided on the lock plate 26. The first cam 361 of the cam member 36 has entered the cam hole 263 of the lock plate 26. When the lever 37 is rotated, the cam member 36 is rotated integrally with the lever 37, so that the first cam 361 pushes a wall face of the cam hole 263 and the lock plate 26 is slid. That is, in the state where the lever 37 has been rotated halfway, shown in FIG. 10, the first cam 361 already acts on the lock plate 26, which means that the lock plate 26 is moving.

Figure 11A:
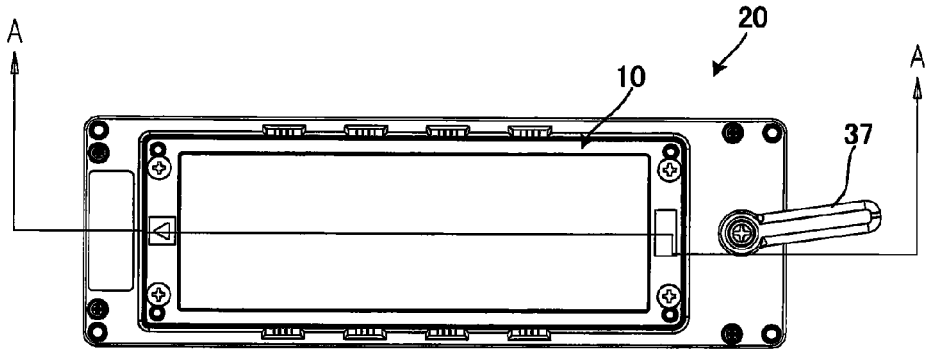
FIG. 11A is a plan view of the mating state shown in FIG. 10A.
Figure 11B:
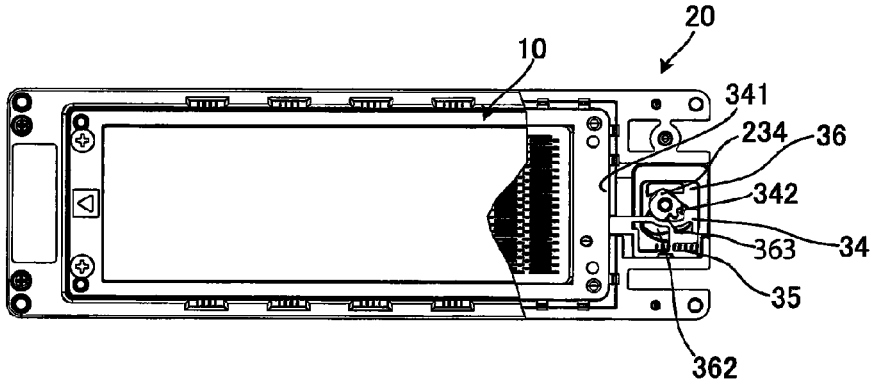
FIG. 11B is a partially-sectioned plan view of FIG. 10A.
Figure 11C:
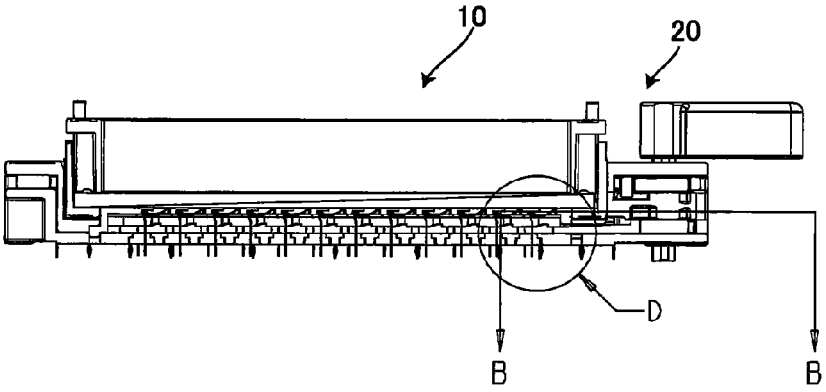
FIG. 11C is a vertical sectional view of FIG. 10A.
Figure 12:
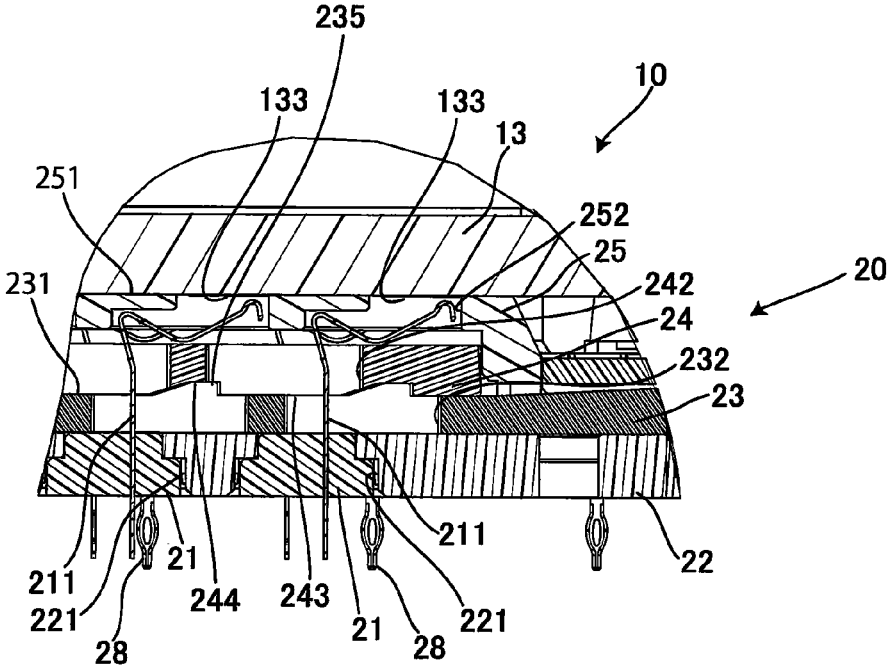
FIG. 12 is an enlarged view of portion D of FIG. 11C.

As shown in FIG. 11(B), the cam member 36 is put in an unlocked state from locking performed by the lock block 34 like FIG. 8(B). However, the cam member 36 has been rotated from the state shown in FIG. 8(B). According to this rotation, the first cam 361 acts on the lock plate 26 to slide the lock plate 26, thereby locking the first connector 10. According to the rotation, the second cam 362 has been also rotated. However, in this stage, the slider 23 is not pushed by the second cam 362 yet, so that it does not start sliding.

In a state where the lever 37 has been rotated up to an attitude shown in FIGS. 10(A) and 10(B), the slider 23 does not start sliding. Therefore, the lift plate 24 has not been lifted up yet, so that the contact 211 remains in a state before being deformed.

Figure 13A:
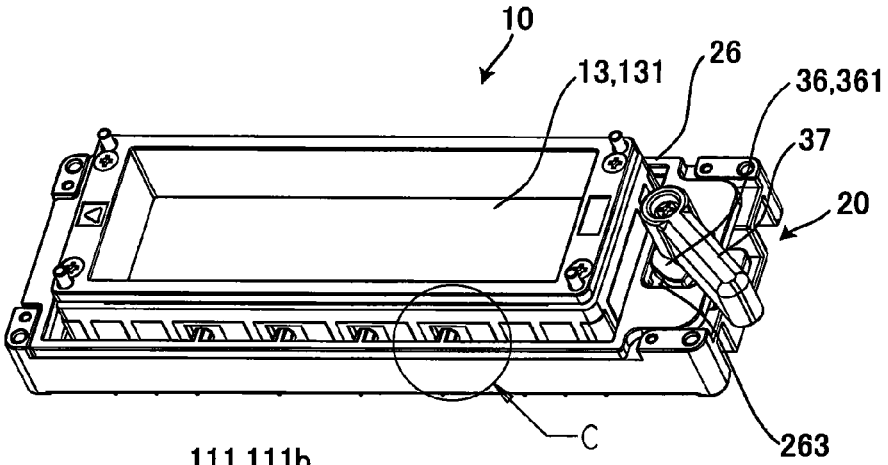
FIG. 13A is a perspective view of the mating state of FIG. 2 in which the lever has been rotated up to its final attitude.
Figure 13B:
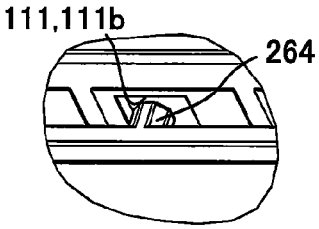
FIG. 13B is an enlarged view of portion C of FIG. 13A.

As shown in this FIGS. 13(A) and 13(B), when the lever 37 is rotated up to the final attitude, the cam member 36 is also further rotated from the state shown in FIGS. 10(A) and 10(B). The first cam 361 of the cam member 36 which has entered the cam hole 263 of the lock plate 26 further pushes the lock plate 26 so that the lock projection 264 is moved laterally up to a final position shown in FIG. 13. Thereby, the first connector 10 is locked to the second connector 20 further securely.

Figure 14A:
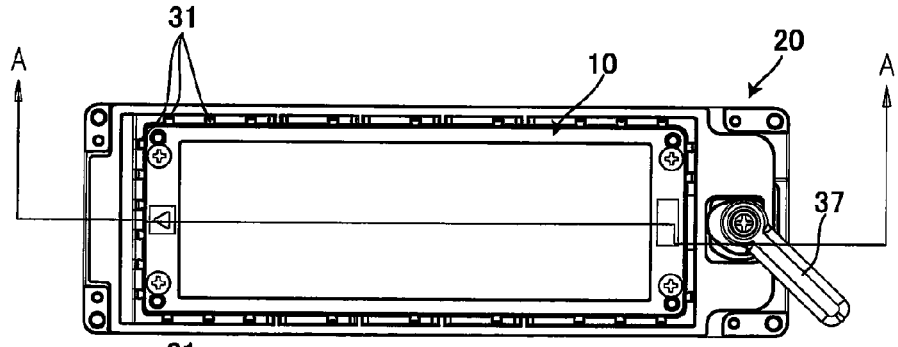
FIG. 14A is a plan view of the mating state shown in FIG. 13A.
Figure 14B:
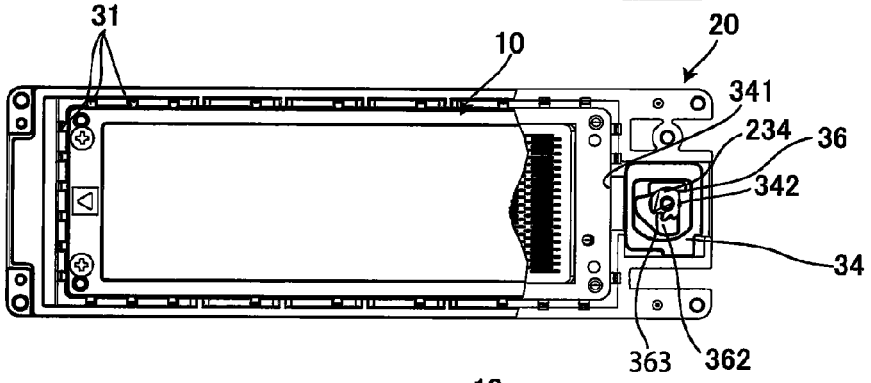
FIG. 14B is a partially-sectioned plan view of FIG. 13A.
Figure 14C:
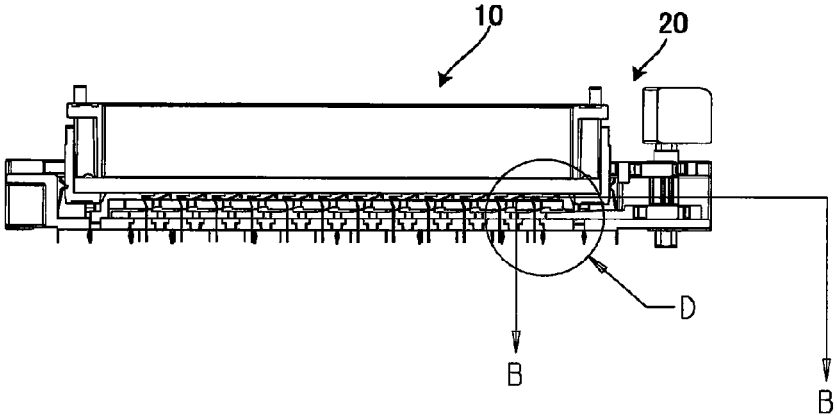
FIG. 14C is a vertical sectional view of FIG. 13A.
Figure 15:
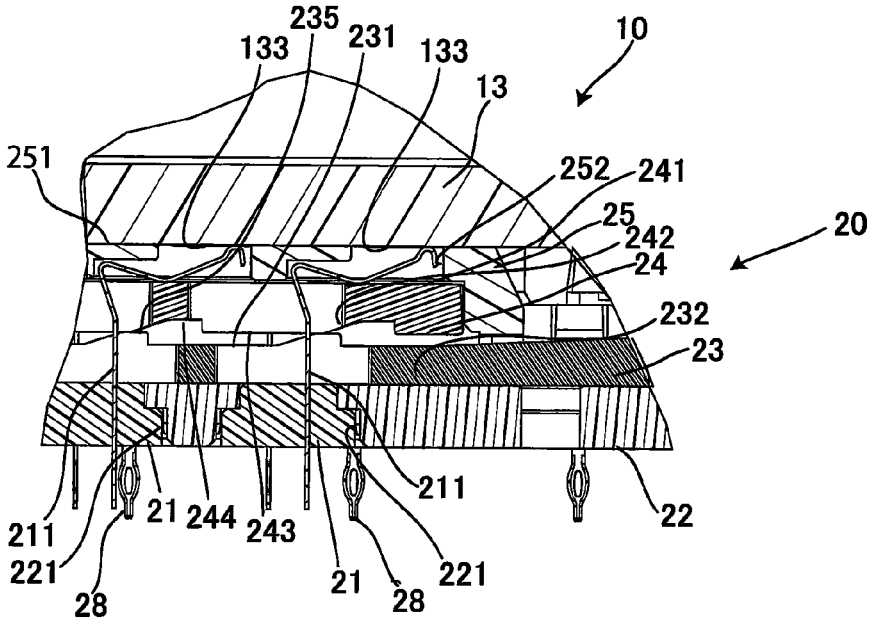
FIG. 15 is an enlarged view of portion D of FIG. 14C.

When the lever 37 is rotated up to the final attitude, the cam member 36 is also rotated up to its final attitude. According to the rotation of the cam member 36, as shown in FIG. 14(B), the second cam 362 which has entered the cam hole 234 of the slider 23 pushes the slider 23 to slide the slider 23.

When the lever 37 is rotated up to the final attitude shown in FIGS. 13(A) and 13(B), the slider 23 also slides in addition to the lock plate 26 which is previously starting sliding. As a result, the projecting portions 235 on the cam face formed on the upper face 231 of the slider 23 overlap with the lower face 243 of the lift plate 23 so that lift plate 23 is lifted up. As a result, a plurality of contacts 211 arranged are simultaneously lifted up by the upper face 241 of the lift plate 24. The upper end portions of the contacts 211 have entered the holes 252 provided in the upper housing 25 and face the circuit board 13 of the first connector 10 just above the upper housing 25. The contact pads 133 are formed on the lower face of the circuit board 13 facing the upper housing 25. Therefore, the contacts 211 which have been lifted up by the lift plate 24 make contact with the contact pads 133 on the lower face of the circuit board 13 securely with a predetermined contact pressure. Here, a plurality of contacts 211 is simultaneously lifted up by one lift plate 24.

Advantageously, variations of the contact pressures or the contact timings can be suppressed as compared with such a configuration that individual contacts 211 are individually lifted up by the cam faces of the members corresponding to the slider 23. The contacts 211 of the second connector 20 can thus be caused to make contact with the contact pads 133 on the circuit board 13 of the first connector 10 with a contact pressure which has been adjusted with high precision.

What is claimed is:

1. A connector comprising:

a circuit board having a plurality of contact pads arranged in a two-dimensional fashion on a first face facing a mating connector side, the plurality of contact pads configured to make contact with a plurality of contacts of the mating connector; and a housing having a locating portion in contact with the first face of the circuit board, the locating portion locating the first face with respect to a direction of mating with the mating connector, and a fixing portion in contact with a second face of the circuit board opposite to the first face, the fixing portion fixing the circuit board in a state of being pressed on the locating portion;

wherein the locating portion includes a first stand portion and a second stand portion disposed on opposite sides of the housing, the first stand portion and the second stand portion are separated by an opening on a lower face side of the housing.

2. The connector according to claim 1, wherein a locating pin is disposed on each of the first stand portion and the second stand portion.

3. The connector according to claim 2, wherein a plurality of lock grooves is disposed on an outside face of the housing.

4. The connector according to claim 3, wherein a plurality of shield contact portions is disposed on an outside face of the housing.

5. The connector according to claim 2, wherein a first tongue portion and a second tongue portion project from opposite sides of the circuit board.

6. The connector according to claim 5, wherein the first tongue portion abuts the first stand portion and the second tongue portion abuts the second stand portion.

7. The connector according to claim 6, wherein the first tongue portion and the second tongue portion each have a plurality of locating holes.

8. The connector according to claim 7, wherein the locating pin on the first stand portion extends through one of the plurality of locating holes on the first tongue portion, and the locating pin on the second stand portion extends through one of the plurality of locating holes on the second tongue portion.

9. The connector according to claim 8, further comprising a cap formed in a dome shape, the cap attached to the housing and enclosing the circuit board.

10. A connector, comprising:

a first connector including a first housing, a slide plate disposed within the housing, a plurality of contacts, and a lever; and a second connector including a circuit board having a plurality of contact pads arranged in a two-dimensional fashion on a first face facing the first connector, the plurality of contact pads configured to make contact with the plurality of contacts of the first connector, and a second housing having a locating portion in contact with the first face of the circuit board, the locating portion locating the first face with respect to a direction of mating with the first connector.

11. The connector according to claim 10, wherein the first connector further includes a lift plate movable by operation of the lever between a first position and a second position.

12. The connector according to claim 11, wherein the plurality of contacts contact the plurality of contact pads in the second position of the lever.

13. The connector according to claim 12, wherein the first housing has a plurality of first lock grooves, and the second housing has a plurality of second lock grooves, the plurality of first lock grooves and the plurality of second lock grooves aligned in a mating position.

14. The connector according to claim 13, wherein the first connector further includes a plurality of lock projections movable within the aligned first and second lock grooves by operation of the lever between the first position and the second position.

15. The connector according of claim 14, wherein the plurality of lock projections lock the first connector to the second connector in the second position of the lever.

16. The connector according to claim 15, wherein the first connector further includes a lock block capable of preventing motion of the plurality of lock projections independent of the motion of the lever.

17. The connector according to claim 12, wherein a shield member of the first connector contacts a plurality of shield contact portions of the second connector.

* * * * *